United States Patent [19]

Fekete et al.

[11] Patent Number: 4,536,169

[45] Date of Patent: Aug. 20, 1985

[54] QUICK RELEASE SPRING POWERED TOY VEHICLE

[75] Inventors: Ferenc Fekete, Huntington Beach; James E. Spears, Hawthorne, both of Calif.

[73] Assignee: Mattel, Inc., Racine, Wis.

[21] Appl. No.: 545,022

[22] Filed: Oct. 24, 1983

[51] Int. Cl.[3] ..... A63H 29/24

[52] U.S. Cl. ..... 446/461; 446/466

[58] Field of Search ..... 446/457, 459, 461, 462, 446/463, 464, 466, 431

[56] References Cited

U.S. PATENT DOCUMENTS

| | | | |
|---|---|---|---|
| 682,454 | 9/1901 | Converse | 46/208 |
| 701,155 | 5/1902 | Converse | 446/461 |
| 728,286 | 5/1903 | Parker | 446/461 |
| 2,064,309 | 12/1936 | Lohr | 46/107 |
| 2,735,222 | 2/1956 | Glass | 46/208 |
| 3,541,725 | 11/1970 | Miura | 446/464 |
| 3,643,375 | 2/1972 | Ginsberg et al. | 46/208 |
| 4,329,810 | 5/1982 | Terui | 446/463 |

*Primary Examiner*—Mickey Yu

*Attorney, Agent, or Firm*—James G. O'Neill; Ronald M. Goldman

[57] ABSTRACT

A toy vehicle (10) is provided having a configuration to simulate any desired vehicle. The toy vehicle includes a base (12) with a unitary spring-powered motor assembly (16) having a rear drive wheel assembly (18, 20), pivotably mounted within the base. The axle of the rear drive wheel assembly includes a detent (32) which coacts with an integral arm (36) formed in the base to lock the unitary spring-powered motor and drive wheel assembly in the wound position. Upon tapping of a finger against the top of the housing, the housing rotates downwardly to release the motor and allow the vehicle to accelerate forwardly.

3 Claims, 6 Drawing Figures

QUICK RELEASE SPRING POWERED TOY VEHICLE

TECHNICAL FIELD

This invention relates to toy vehicles, and more particularly to a toy vehicle having a spring powered motor which is locked in its wound-up position and which may be quickly released by application of a light force to the body of the toy vehicle.

BACKGROUND ART

U.S. Pat. No. 682,454 discloses a stop-motion mechanism for a spring-wound vehicle. This mechanism includes a star wheel which is keyed to the rear axle of the vehicle, and a leaf spring which is fixed to the underside of the vehicle. The leaf spring extends to position behind the axle and includes a leg which depends to a position adjacent the ground. A wheel is rotatably mounted at the lower end of the leg for engagement with the ground. A notch is formed in the leaf spring in front of the star wheel so that the notch will engage the star wheel when the rear wheels of the vehicle are lifted above the ground. The star wheel is prevented from rotating by notch 16 thereby preventing the gear train in the spring-wound motor from operating.

U.S. Pat. No. 2,064,309 discloses a stop-motion mechanism having a feeler pivotably mounted in the vehicle chassis by a cross member. The feeler includes a link which is pivotably mounted to a detent lever. The detent lever includes a detent which is normally biased into engagement with a gear by a torsion spring. When the vehicle disclosed is running on the ground, the feeler urges the link clockwise to withdraw the detent from the gear. If the wheels of the vehicle leave the ground, the force exerted by the feeler is removed and the torsion spring pulls the detent into engagement with the gear to stop the spring-wound motor.

U.S. Pat. No. 2,735,222 discloses a stop-motion mechanism for a spring-wound motor which is released when a weight is added to the vehicle. The spring-wound motor includes a star wheel which under normal circumstances is blocked by a lever. When a weight is added to the vehicle, a further lever moves the first lever out of engagement with the star wheel to allow the spring-wound motor to operate. Thus, the vehicle will not move until the pre-determined weight is placed on, and remains on the vehicle.

U.S. Pat. No. 3,643,375 discloses a simulated coaster which is mounted on a small spring-wound vehicle so that the coaster will move when a glass of liquid is placed on the coaster. Without weight on the coaster a fixed, upstanding stop is engaged by a tab to lock a gear in the spring-wound motor. When a weight is placed on the coaster, such as a glass of water, the body of the coaster is moved downwardly with respect to the spring motor so that the tab moves above the fixed stop to release the gear and allow the spring motor to drive the vehicle. This patent also discloses a stop mechanism whereby when the vehicle reaches the edge of a table, the vehicle will stop. This is accomplished when the nose portion of the stop mechanism drops below the level of the table top to rock the stop mechanism about a pivot until a finger is engaged by the tab to stop the motor.

None of the foregoing prior art relates to means which will stop a fully wound spring-powered motor in a toy vehicle and which allows the vehicle to be operated by the quick application of a light force to the body of the vehicle. These prior art vehicles, lack the desired play value offered by the present invention.

DISCLOSURE OF THE INVENTION

In one aspect of the present invention, there is provided a toy vehicle with a housing having a base and an upper portion configured to simulate a vehicle. A front wheel assembly, including an axle and a pair of wheels, is attached to the base, and a spring-powered motor assembly, adapted to drive a rear wheel assembly having an axle and a pair of wheels, is also held in the base. The axle of the rear wheel assembly includes a detent means affixed thereto and a holding means is formed integrally with the base, in alignment with the detent means, whereby the spring-powered motor assembly may be wound and locked in the wound position by the coaction of the holding means with the detent. The vehicle is released and allowed to move forward by the quick application of a light downward force to the rear of the upper portion of the housing.

DESCRIPTION OF THE DRAWINGS

Other objects, features and advantages of the invention will become apparent from a reading of the specification, when taken in conjunction with the drawings, in which like reference characters refer to like element in the several views.

BEST MODE FOR CARRYING OUT THE INVENTION

Figure 1:
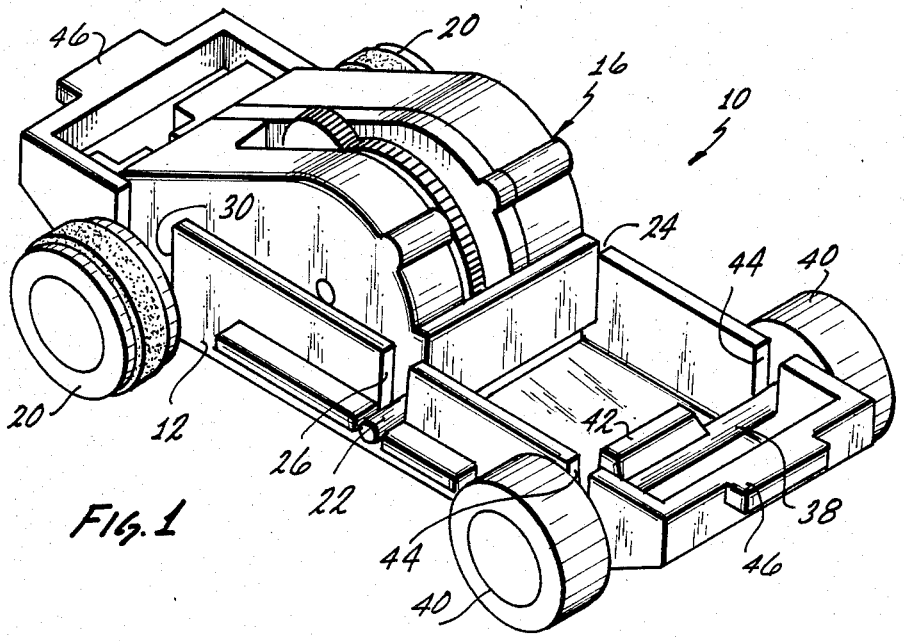
FIG. 1 is a perspective view of the toy vehicle of the present invention with the top portion of the housing removed to show the spring-wound motor held within the base.

Referring now to the drawings, there shown is a preferred embodiment of toy vehicle 10 of the present invention. The vehicle includes a housing with a separate base or frame 12 and an upper body shell or portion 14. The housing is generally configured to simulate a vehicle. A unitary spring-wound motor assembly or module 16, including a motor and a rear drive axle or shaft 18, supporting a pair of rear drive wheels 20, is rotatably mounted within the base 12 by means of a pivot rod 22 held in the motor assembly 16 and extending from either side thereof. The pivot rod is captured in slots 24, 26 formed centrally in the base 12.

When spring motor assembly 16 is rotatably mounted in the base with the pivot rod 22 within slots 24, 26, the rear drive shaft 18 is moveably or slidingly held within further slots 28, 30 formed at the rear of the base. The rear drive shaft 18 is also provided with a detent means 32 fixed to or formed integrally on one side of the shaft to rotate therewith. Base 12 includes an opening 34 in its lower surface forming part of the detent means 32 when the spring motor assembly 16 is mounted with the base. A holding means 36, such as an extending finger is formed on one side of the opening 34 for coaction with the detent means 32 to prevent rotation of the rear drive shaft 18 and therefore locking or stopping the spring motor within assembly 16. The detent means and holding means work best with a high speed, low torque output axle. If changed around to low speed, high torque, the detent and holding means will have a tendency to lock, thus causing starting problems.

Base 12 is also provided with a front axle 38 having front wheels 40 fixed thereto on either side of the base. The front axle is held within the base by means of a resilient arm 42, after being inserted into a pair of slots 44 formed, on either side, near the front of the base. The body shell or top portion 14 is fitted or snapped over the base and held thereto in any convenient manner, as by extending holding means or fingers 46 formed at the front and rear of the base.

The operation of the assembled toy vehicle of the present invention will now be described. The spring powered motor 16 is wound by pressing the vehicle 10 down and moving it in the direction of the arrow 48 (FIG. 3) over a floor or other surface. This movement of the vehicle causes a rubbing or scrubbing action on the rear wheels 20, to turn them in the direction of the arrow 50, thereby winding the spring motor 16. Since the rear of the vehicle is down (or the motor module pivoted upwardly), and the detent means 32 rotates with the axle 18, in the direction of the arrow 50, detent 32 passes over the holding means 36. However, once the scrubbing action of the vehicle over the surface is stopped, the rear of the released and/or raised vehicle (motor module pivoted downwardly) is lifted and the detent means 32 coacts with or engages the holding means 36, as by one of a plurality of finger 52 formed about axle 18, to lock the spring drive motor 16. As shown in more detail in FIGS. 3*a* and 4*a*, both the fingers 52 and the holding means 36 are provided with small back drafts for improved locking. Again, this locking means works best with a high speed, low torque output axle 18 from motor 16.

Figure 3:
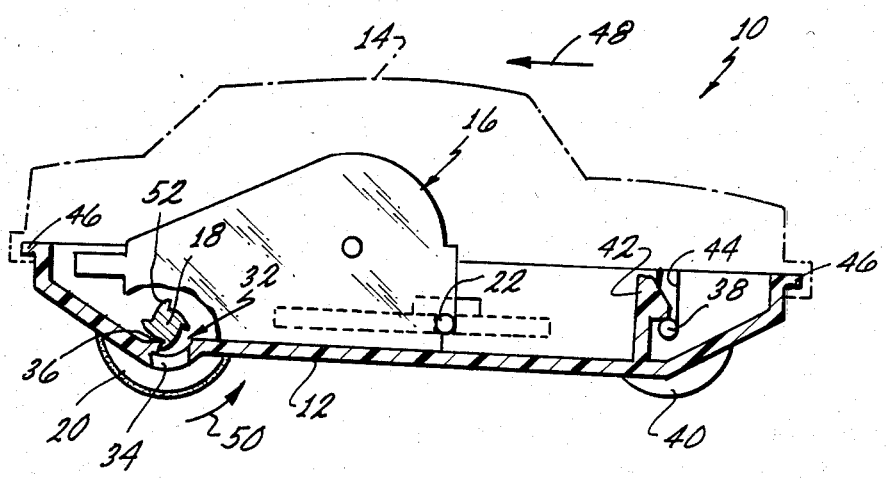
FIG. 3 is a partial side elevational view showing the vehicle moving in the direction to wind the spring-powered motor.
Figure 3A:
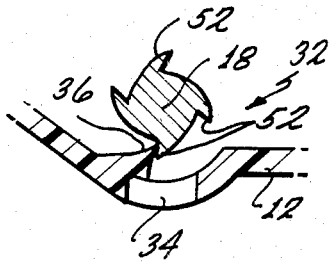
FIG. 3*a* is an enlarged partial sectional view showing details of the detent and holding means, in the locked position.
Figure 2:
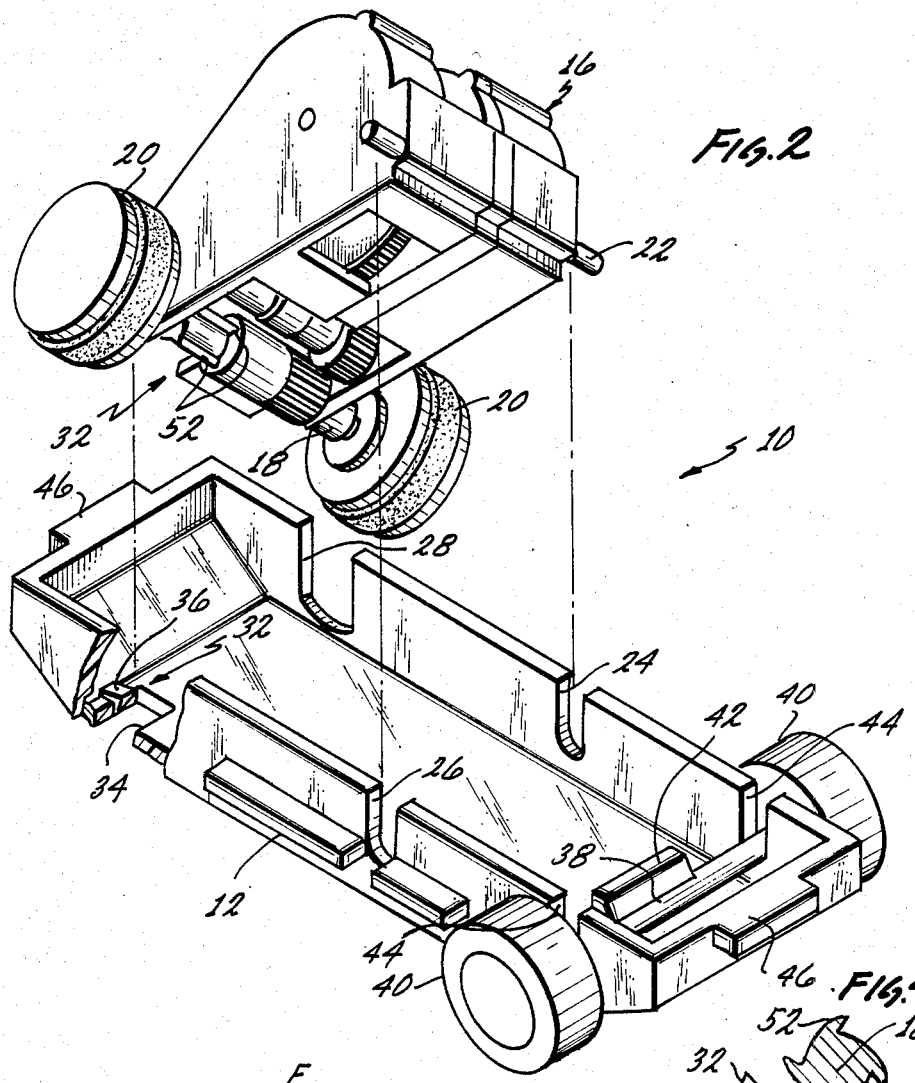
FIG. 2 is a partial perspective exploded view similar to FIG. 1, showing the spring-wound motor and rear wheel assembly in position to be inserted into the base.
Figure 4A:
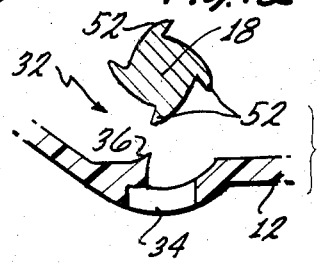
FIG. 4*a* is an enlarged partial sectional view similar to FIG. 3*a*, showing the detent and holding means in the released position.
Figure 4:
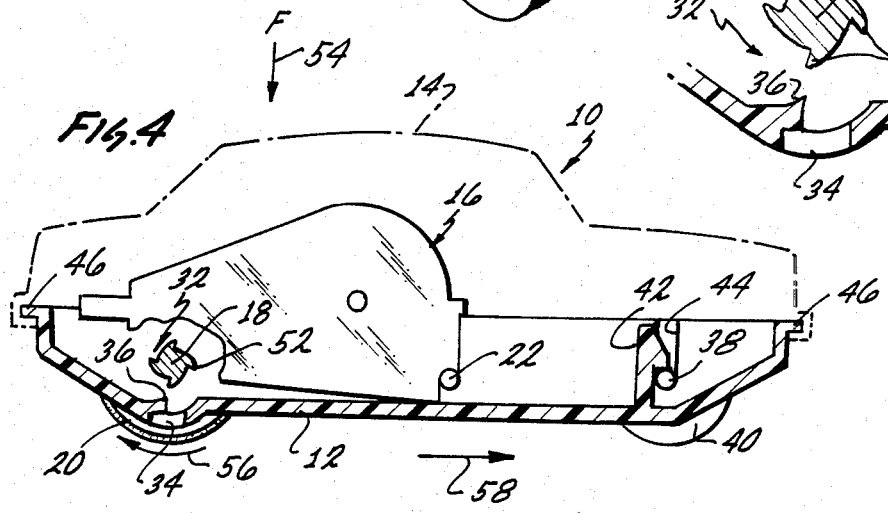
FIG. 4 is a view similar to FIG. 3 showing the vehicle moving forward after a light downward force has been applied to the rear upper portion thereof.

After the vehicle is fully wound and placed on a surface, as shown in FIG. 3, the vehicle may be operated, by applying a quick light force F, such as the tapping of a person's finger, against the rear of the body shell 14, as shown by arrow 54 in FIG. 4. The quick application and removal of the force F causes the rear of the body shell 14 and base 12 to move or rotate downwardly, with respect to the spring drive motor 16 about pivot 22. This movement releases the detent means 32. That is, the finger 52 contacting the holding means 36 is released to thereby unlock the motor 16. The downward movement of the housing and release or unlocking of the spring drive motor (see FIGS. 4 and 4*a*) allows the motor to unwind, driving the rear axle or drive shaft 18 which rotates the wheels 20 in the direction of the arrow 56, to accelerate the vehicle 10 forwardly, in the direction of the arrow 58.

It therefore can be seen that applicants have developed a new and novel toy vehicle which may be wound to any desired spring tension with the spring drive motor automatically locked. The vehicle is then placed on a surface, and quickly and easily operated by the user by merely tapping the rear of the vehicle. The locking means prevents the premature unwinding of the spring motor.

While the particular toy vehicle of the present invention has been described in considerable detail, it is to be understood that this description is merely illustrative of the invention and that no limitations are intended other than as found in the attached claims.

We claim:

1. A toy vehicle comprising a housing having a separate base and an upper body portion, the base and the upper body portion being removably held together and configured to simulate a toy vehicle;

a front surface engaging wheel assembly resiliently held to the base by means of an axle held between a pair of wheels; and a unitary spring-powered motor and rear surface engaging driving wheel assembly pivotably mounted within the base of the housing by means of a pivot rod held to said motor and captured within said base; the rear assembly including an axle and a pair of rear drive wheels connected with a gear train held within the spring-powered motor assembly; and detent means, having a plurality of fingers thereon fixed to the rear axle for rotation therewith; the base including an opening formed therein in alignment with said detent means on the rear axle; an integral arm formed on the base and extending into the opening to enable the arm to coact with the fingers of the detent means in one position to lock the spring-powered motor assembly in the wound position; whereby the spring-powered motor assembly may be unwound to accelerate the toy vehicle by the quick application and removal of a light force to the rear of the top portion of the vehicle to thereby rotate the base and top portion of the vehicle around said pivoted rod, in relation to the unitary spring-powered motor assembly, to a second position to thereby release the detent means from the integral arm.

2. The toy vehicle of claim 1 wherein the rear axle is driven at high speed and low torque by the spring-powered motor assembly.

3. The toy vehicle of claim 1 wherein the end of the intergral arm and the ends of each of the fingers on the detent means include a back draft to improve the locking action thereof.

* * * * *

UNITED STATES PATENT AND TRADEMARK OFFICE

CERTIFICATE OF CORRECTION

PATENT NO. : 4,536,169

DATED : August 20, 1985

INVENTOR(S) : Ference Fekete, and James E. Spears

It is certified that error appears in the above-identified patent and that said Letters Patent is hereby corrected as shown below:

On the Title Page for Assignee:

the address should be changed to

--Hawthorne, California--.

Signed and Sealed this

Twenty-seventh Day of January, 1987

*Attest:*

DONALD J. QUIGG

*Attesting Officer* *Commissioner of Patents and Trademarks*